US011224297B2

(12) United States Patent
Ishay et al.

(10) Patent No.: US 11,224,297 B2
(45) Date of Patent: Jan. 18, 2022

(54) SYSTEM FOR MULTI-DIMENSIONAL STIFFNESS CONTROL OF SURFACES

(71) Applicants: Eran Ishay, Tel Aviv (IL); Yariv Dror Mizrahi, Raanana (IL)

(72) Inventors: Eran Ishay, Tel Aviv (IL); Yariv Dror Mizrahi, Raanana (IL)

( * ) Notice: Subject to any disclaimer, the term of this patent is extended or adjusted under 35 U.S.C. 154(b) by 253 days.

(21) Appl. No.: 16/295,123

(22) Filed: Mar. 7, 2019

(65) Prior Publication Data

US 2019/0274447 A1 Sep. 12, 2019

Related U.S. Application Data

(60) Provisional application No. 62/639,532, filed on Mar. 7, 2018.

(51) Int. Cl.
*A47C 31/12* (2006.01)
*A47C 27/16* (2006.01)

(52) U.S. Cl.
CPC ..... *A47C 31/123* (2013.01); *A47C 27/16* (2013.01)

(58) Field of Classification Search
CPC ..... A47C 31/123; A47C 27/16; A47C 27/04; A47C 27/045; A47C 27/0456; A47C 27/068; A47C 23/002; A47C 23/0436; A47C 23/05; A47C 23/0522; A47C 23/055; A47C 23/066; A47C 23/14; A47C 23/145; A47C 23/15; A47C 23/18; A47C 23/22; A47C 23/26; A47C 23/28
USPC ..... 267/73, 74, 97, 101, 103, 105, 111
See application file for complete search history.

(56) References Cited

U.S. PATENT DOCUMENTS 1,335,984 A * 4/1920 Piper ..... A47C 23/22 5/192
1,525,248 A * 2/1925 McKellar ..... A47C 23/22 5/190
1,603,227 A * 10/1926 Wilcken ..... A47C 23/22 5/192
1,768,189 A * 6/1930 Cohn ..... A47C 23/22 5/203
2,272,652 A * 2/1942 Wiener ..... A47C 23/22 5/232
3,596,299 A * 8/1971 Klicki ..... A47C 23/04 5/247
3,841,618 A * 10/1974 Solomons ..... A47C 23/145 267/110
4,004,303 A * 1/1977 Mandusky ..... A47C 23/145 5/247
4,799,276 A * 1/1989 Kadish ..... A61G 7/0573 137/901
5,165,125 A * 11/1992 Callaway ..... A47C 23/002 267/148
5,184,802 A * 2/1993 Galumbeck ..... A47C 23/05 267/103
5,332,202 A * 7/1994 Wagner ..... A47C 23/002 267/82

(Continued)

*Primary Examiner* — Peter M. Cuomo
*Assistant Examiner* — Rahib T Zaman
(74) *Attorney, Agent, or Firm* — Dekel Patent Ltd.; David Klein

(57) ABSTRACT

An elastic device providing means of controlling its stiffness by controlling the tension of the string or group of springs resulting in adjustable transverse stiffness of it, arranged in matrix to enable the control of spatial stiffness of a 2D matrix in unlimited resolution.

7 Claims, 4 Drawing Sheets

(56) References Cited

U.S. PATENT DOCUMENTS

| | | | | |
|---|---|---|---|---|
| 6,134,729 | A * | 10/2000 | Quintile | A47C 23/002 267/103 |
| 7,287,291 | B2 * | 10/2007 | Carlitz | A47C 23/002 5/260 |
| 2014/0137337 | A1 * | 5/2014 | DeFranks | A47C 27/14 5/723 |

* cited by examiner

| | c1<br>c11…c1n | c2<br>c21…c2n | c3<br>c31…c3n | .<br>… | .<br>… | cm<br>cm1…cmn |
|---|---|---|---|---|---|---|
| r1 r11…r1m | P11<br>S11=c11·(Tc11+Tr11) | P12<br>S12=c12·(Tc21+Tr12) | P13<br>S13=c13·(Tc31+Tr13) | | | P1m<br>S1m=c1m·(Tcm1+Tr1m) |
| r2 r21…r2m | P21<br>S21=c21·(Tc12+Tr21) | P22<br>S22=c22·(Tc22+Tr22) | | | | P2m<br>S2m=c2m·(Tcm2+Tr2m) |
| r3 r31…r3m | P31<br>S21=c31·(Tc13+Tr31) | | | | | |
| . … | | | | | | |
| . … | | | | | | |
| . … | | | | | | |
| . … | | | | | | |
| rn rn1…rnm | Pn1<br>Tn1=cn1·(Sc1n+Srn1) | | | | | Pnm<br>Srm=cnm·(Tcmn+Tr2=nm) |

SYSTEM FOR MULTI-DIMENSIONAL STIFFNESS CONTROL OF SURFACES

FIELD OF INVENTION

The present invention is directed to controlling stiffness (firmness) of a surface, such as a bed mattress, in two or three dimensions and in a high resolution, e.g., controlling stiffness of every point on a surface separately and independently.

BACKGROUND

In a bed or any other body supporting surface arrangement, a support is provided to support the weight or part of the weight of a user, wherein the bed distributes the weight from the body of the user over a part of a surface of the device. Depending on how the supporting surface distributes the weight of the user, the surface appears to be soft or firm. The degree of firmness (or stiffness) of such a surface is dependent on the properties of its elastic elements, such as the spring constant, and how the elastic members have been mounted in the surface, such as the degree of clamping or pre-tensioning. Thus, the firmness of the bed is normally set during the manufacturing of the device.

However, different users wish and require different firmness. Further, different body parts may require different firmness at different zones.

It is known to provide bed arrangements with variable firmness. By inducing deformation to the elastic members to different degrees, the firmness of the device is adjustable. The deformation member can deform the elastic member independently of the deformation of the elastic member induced by the being. This means that the firmness of the bed is adjustable during initialization, according to the wishes of the user. It is also possible to compensate the firmness of the device for possible changes in the elastic properties of the elastic arrangement over time. Still further, it is known to vary the firmness independently in various zones/sections in a mattress.

Further, it is known to provide variation in firmness of a mattress by arranging coil springs on support plates having variable height. The height of the support plates may be controlled by rotatable elements arranged under the support plates and having an off-center rotation axis. By rotation of the rotatable elements, the plates assume various height positions. It is also known to use a similar arrangement with support plates having variable height where the height of the support plates may be controlled by displacement members in the form of linear motors, jacks, and other types of lifting mechanisms.

It is also known to provide zones having variable firmness realized by inflatable elements, in which the pressure is independently variable by means of pressurization means.

Further, it is known to realize mattresses with variable firmness by a combination of inflatable elements and other resilient elements, such as coil springs.

Many other firmness adjustment means be also feasible, such as by arranging threads through the mattress, whereby the height position and/or tension is variable.

However, common problems with these previously known bed arrangements with variable firmness are that they are relatively complex, heavy and costly to produce. Further, these known bed arrangements are also often relatively difficult and cumbersome to use. Further, even though these known bed arrangements provide a certain degree of adjustability, this is often inadequate for the users' needs. Also, those solutions mainly provide control of firmness in a single dimension, whereas a two dimensional firmness control is needed.

It is therefore still a need for a bed arrangement with adjustable zone firmness.

The present invention relates to novel apparatus which enables the control of stiffness of a surface in two-dimensional resolution or a volume in three-dimensional resolution. More particularly, the invention relates to a device which enables controlling the stiffness of every point on a surface independently and in unlimited resolution (unlimited number of zones).

SUMMARY

The current invention aims in replacing coil springs in a mattress or any other elastic surface with longitudinal strings, which may also be embedded with springs or any other elastic member along it.

The tensioned strings control the firmness of the surface at any point thereon, and are scalable to any resolution required.

Thus the invention provides an elastic device with controlled stiffness. This is achieved by controlling the tension of the string(s) resulting in adjustable transverse stiffness of the string(s), arranged in a matrix so as to enable controlling spatial stiffness of a 2D matrix in unlimited resolution.

The height of the elastic device may also be adjusted by controlling the tension of the string or group of springs.

A cushioning spring may be coupled to at least some of the strings to provide additional cushioning and damping to the elastic device.

At least some of the junctions (loading points) may be preloaded with a biasing device (e.g., spring) to a lower height, so as to provide a combined height control and stiffness control.

A pressure sensing sensor or rug may be placed on top or inside of the junction to be used as a feedback for controlling the pressure at each junction.

A voice sensor may be used as a feedback for controlling the pressure at each junction. A camera may be used as a feedback for controlling the pressure at each junction. The surface stiffness can be changed with time, thereby providing a time-varying stiffness.

A supporting layer may cover the upper surface of the loading points.

A frame may be used to hold the strings at their ends to provide means of pre-tensioning.

A foam material may fill all or a portion of the volume beneath the loading points to provide further cushioning and/or additional dampening for the arrangement.

DETAILED DESCRIPTION

The present invention provides a supporting device for, such as but not limited to, mattresses, trampolines, treatment beds, anti-bedsore-systems, emergency patients beds, etc. The invention is an elastic element that consists of a string or strings system, or strings integrated with another elastic element. Since the string's longitudinal tension influences its transverse firmness, hence by adjusting the string's longitudinal tension, one can control its transverse stiffness. This can be applied on a plurality of strings, each pair or more, supporting each point in a 2D matrix configuration to enable 2D stiffness control with unlimited resolution.

Loading points or junctions (1) are distributed in a matrix of rows and columns or any other arrangement. Each of the junctions 1 are attached to one or more strings (2) in two or more directions, usually longitudinal and transverse, set as a rows and columns, although any other arrangement is valid. Each of the strings is tensioned to a different value using a tension mechanism (3). This results in an assembly of which each junction is independent from the other junctions, so each junction can be separately and independently controlled.

The string arrangement to each loading point can be one string, two strings or more, and each string contributes to the transverse stiffness of the loading point. String tension is $T_1$, $T_2$, $T_3$, . . . $T_a$ where a is the total number of strings supporting a loading point. Since the transverse stiffness of a loading point is proportional to the tension of the string, the stiffness of a loading point supported by a single string is $C \cdot T_1$, the stiffness of a loading point supported by two strings is $C \cdot (T_1+T_2)$ and so on. Thus, in general, the transverse stiffness of a loading point is $C \cdot (T_1+T_2+T_3+ \ldots +T_a)$, where C is a multiplication factor, which may be different for every junction depending on the junction parameters. Moreover, C may be different for each string; for example, if the strings are not identical, the total stiffness of a loading point is $(C_1T_1+C_2T_2+C_3T_3+ \ldots +C_aT_a)$.

Figure 1:
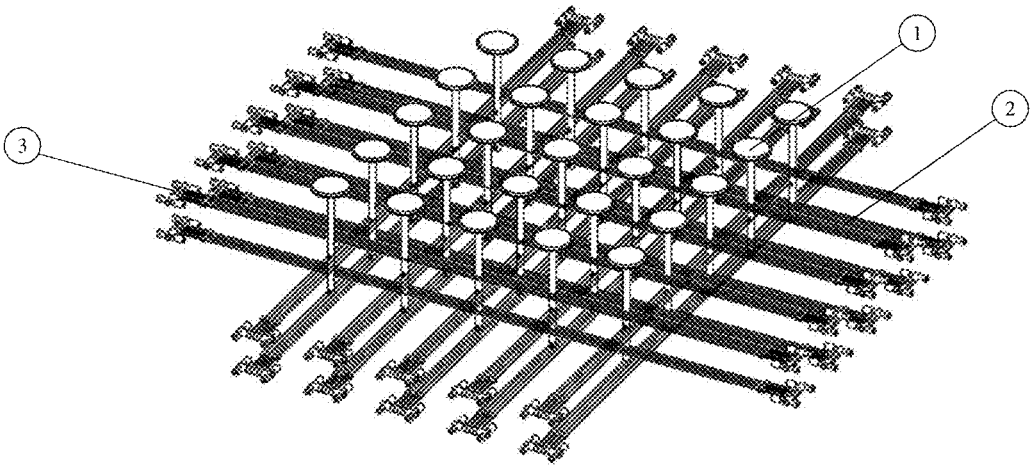
FIG. 1 is an isometric view of a 5×5 matrix.
Figure 2:
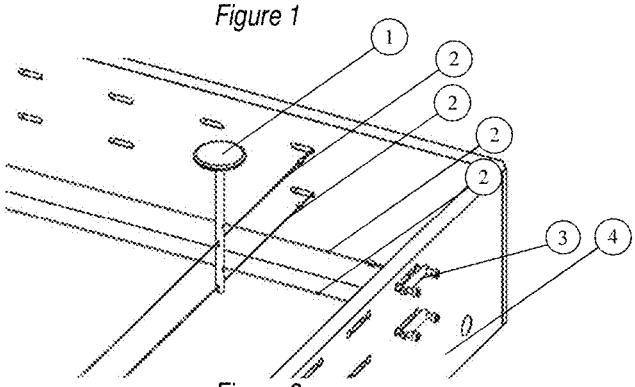
FIG. 2 is an isometric view of a single point of load (junction), isolated from all other points of load with a sample 4 strings support.
Figure 3:
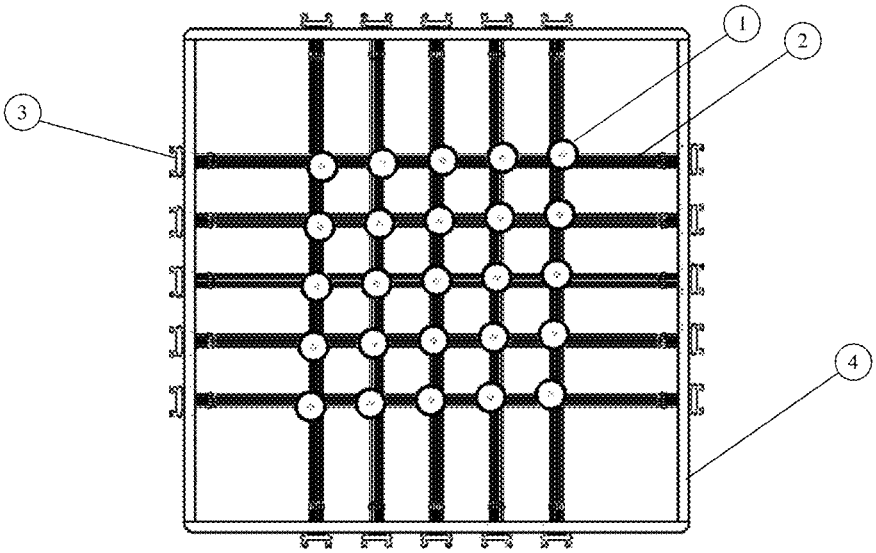
FIG. 3 is a top view of a 5×5 matrix (25 points resolution) of a support surface.
Figures 4, 5:
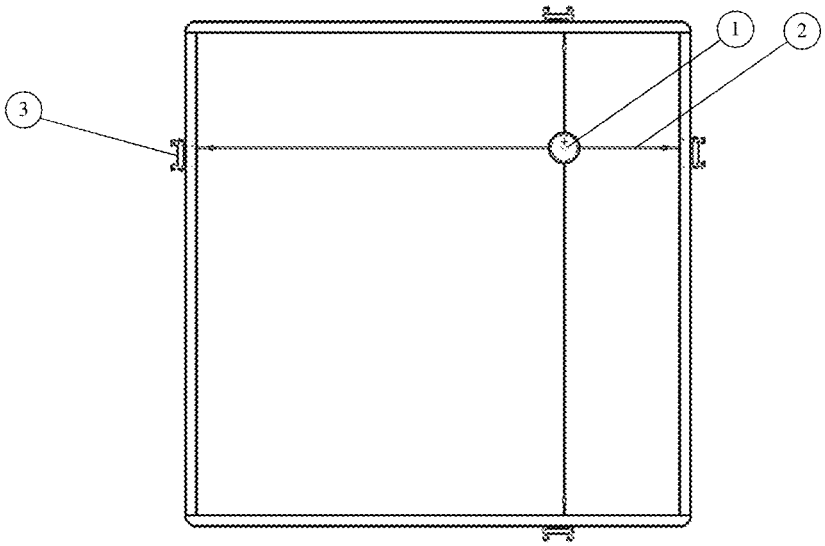
FIG. 4 is a top view of a single point of a matrix, isolated from all other points.
FIG. 5 is a scheme presenting an n×m matrix with related stiffness calculation in each point.

FIG. 5 describes a general possible matrix configuration. $c_1$-$c_m$ represents the columns numbers (total of m columns), $r_1$-$r_n$ represents the rows number (total of n rows). $P_{11}$-$P_{nm}$ represents the junction's numbers (total junctions are n·m). In this figure, each junction is connected to 2 strings—column string and row string. For example, junction $P_{11}$ is connected to string $c_{11}$ and $r_{11}$, $P_{12}$ is connected to string $c_{21}$ and $r_{12}$, etc., so the general junction $P_{nm}$ is connected to string $c_{nm}$ and $r_{mn}$. The stiffness of each junction is a function of its related string tension (T); therefore, in general, junction $P_{nm}$ stiffness (S) is equal to $c_{nm} \cdot (Tc_{mn}+Tr_{nm})$ where $Tc_{mn}$ is the tension of string $c_{mn}$ and $Tr_{nm}$ is the tension of string $r_{nm}$.

Figure 6:
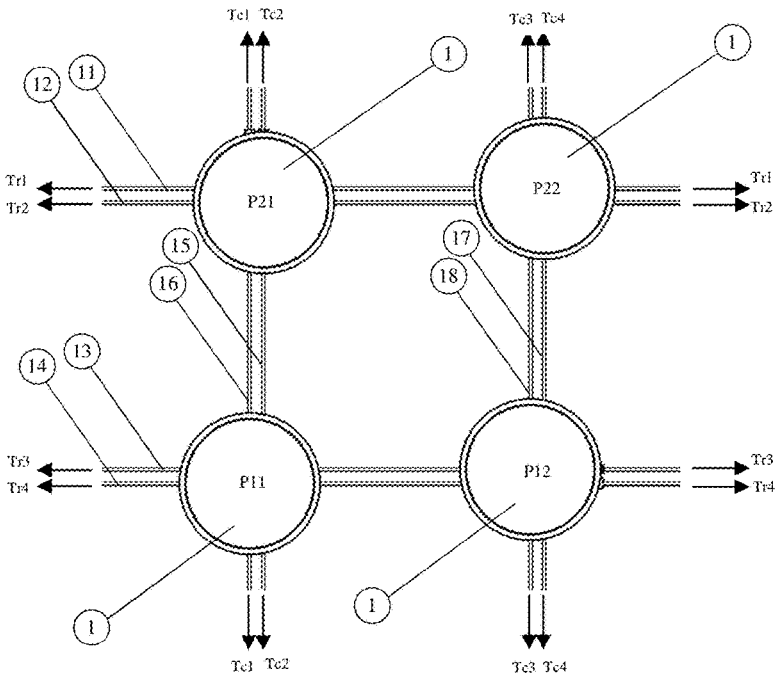
FIG. 6 is a top view of a simplified 2×2 matrix with the related strings and tension forces on each point enabling the control of the point stiffness.
Figure 7:
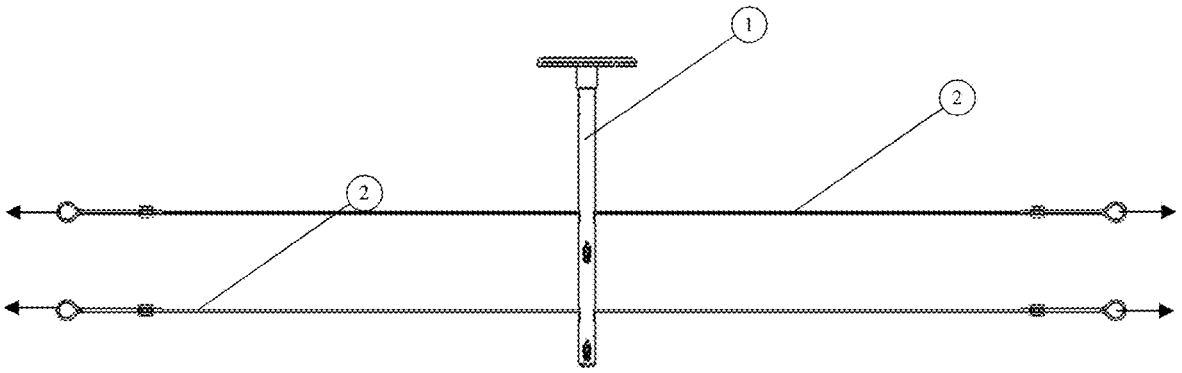
FIG. 7 is a side view of a single point in a matrix connected with four strings in a junction (2 in a column and 2 in a row).
Figure 8:
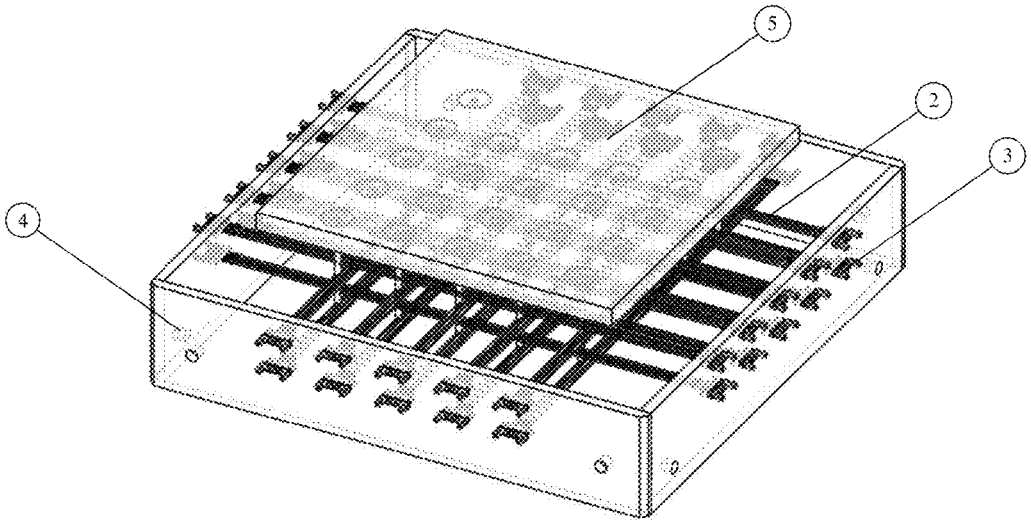
FIG. 8 is an isometric view of a full matrix with supporting frame and upper cushioning layer.
Figure 9:
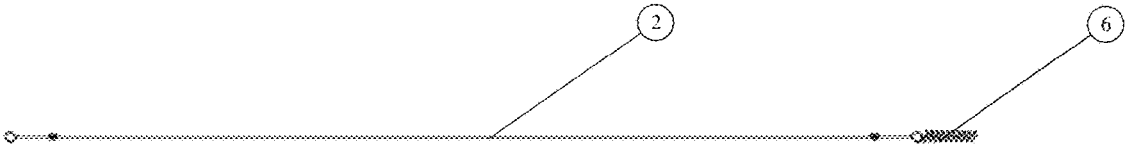
FIG. 9 is a side view of a single string with additional spring.
Figure 10:
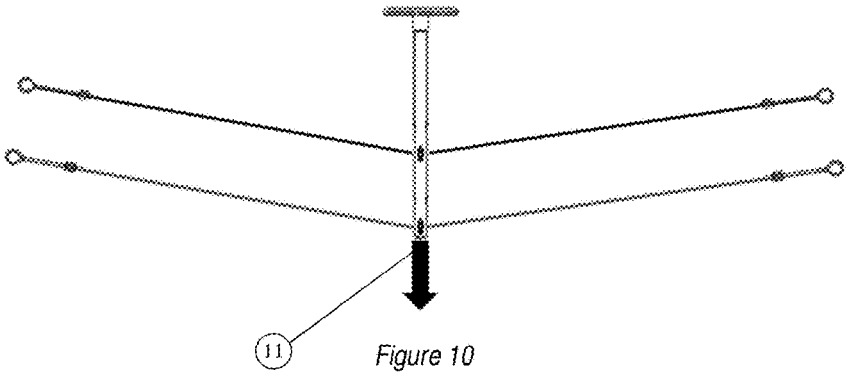
FIG. 10 is a side view of a single point in a matrix connected with four strings in a junction (2 in a column and 2 in a row) preloaded, to provide means to control the height position of a junction.

FIG. 6 describes an example of a 2×2 matrix of loading points $P_{11}$, $P_{12}$, $P_{21}$ and $P_{22}$. Each loading point is supported by 2 strings in this example, but it is not limited to two and can be connected to more than 2 strings in any configuration. Loading point $P_{11}$ is supported by strings (16) and (14) having tensions $Tc_1$ and $Tr_4$ respectively. Loading point $P_{12}$ is supported by strings (18) and (13) having tensions $Tc_3$ and $Tr_3$ respectively. Loading point $P_{21}$ is supported by strings (15) and (12) having tensions $Tc_2$ and $Tr_2$ respectively. Loading point $P_{22}$ is supported by strings (17) and (11) having tensions $Tc_4$ and $Tr_1$ respectively. This exemplary arrangement of 2×2 results in 4 different stiffnesses for each of the loading points as follows: Stiffness of loading point $P_{11}$ is $C_{11} \cdot (Tc_1+Tr_4)$; stiffness of loading point $P_{12}$ is $C_{12} \cdot (Tc_3+Tr_3)$; stiffness of loading point $P_{21}$ is $C_{21}*(TC_2+Tr_2)$; stiffness of loading point $P_{22}$ is $C_{22} \cdot (Tc_4+Tr_1)$. C represents a general constant or parameter and is not necessarily the same for each of the loading points.

On top or in the volume of the points of load there may or may not exist an additional supporting layer of foam or any other type of material or structure which assists in averaging the stiffness. The support layer may be added on top of the points of loads.

Tensioning mechanism (3), either manual, pneumatic, electrical or any other external energy source may or may not be connected to the string or a group of strings to control the string/s tensioning and thus control the transverse stiffness of every point of load.

A pressure sensing sensor or any other sensing mechanism may be installed on the surface, or cover the whole upper surface of the point of load or on top of the supporting layer to sense the pressure on every point over the 2D surface to feedback to the tensioning mechanisms and by using a dedicated algorithm to control each supporting point or a group of points stiffness.

The strings may or may not be attached to the tension mechanism (3) directly. For example, they may be coupled with a connecting spring (6) which provides additional flexibility to the string.

Each or some of the junctions can be preloaded transversely with a biasing device such as a spring or another element (11) to adjust or lower the initial height, thereby controlling the height of each junction.

What is claimed is:

1. An elastic device comprising: a matrix of loading points, each of said loading points being attached to one or more strings in two or more directions, wherein each of said strings is coupled to a tension mechanism independently of the other strings, and wherein a transverse stiffness of a particular one of said loading points is proportional to tensions of said strings that are coupled to said particular one of said loading points, and wherein each of said strings is coupled with a connecting spring to said tension mechanism, wherein said tension mechanism is configured to adjust the tension of each of said strings.

2. The elastic device according to claim 1, wherein said two or more directions are longitudinal and transverse to define rows and columns.

3. The elastic device according to claim 1, wherein said loading points are arranged in rows and columns.

4. The elastic device according to claim 1, further comprising an additional supporting layer of foam next to said loading points.

5. The elastic device according to claim 1, wherein each of said strings is attached directly to said tension mechanism.

6. The elastic device according to claim 1, further comprising a pressure sensor configured to sense pressure at at least one of said loading points.

7. The elastic device according to claim 1, further comprising a biasing device to adjust a height of at least one of said loading points.

* * * * *